US009556866B2

(12) United States Patent
Breuer

(10) Patent No.: US 9,556,866 B2
(45) Date of Patent: Jan. 31, 2017

(54) RADIAL PISTON MACHINE AND PISTON FOR A RADIAL PISTON MACHINE OF THIS TYPE

(75) Inventor: David Breuer, Tuebingen (DE)

(73) Assignee: Robert Bosch GmbH, Stuttgart (DE)

( * ) Notice: Subject to any disclaimer, the term of this patent is extended or adjusted under 35 U.S.C. 154(b) by 935 days.

(21) Appl. No.: 13/811,543

(22) PCT Filed: Jun. 22, 2011

(86) PCT No.: PCT/EP2011/003083

§ 371 (c)(1),
(2), (4) Date: Mar. 29, 2013

(87) PCT Pub. No.: WO2012/010241

PCT Pub. Date: Jan. 26, 2012

(65) Prior Publication Data

US 2013/0209301 A1 Aug. 15, 2013

(30) Foreign Application Priority Data

Jul. 23, 2010 (DE) ..... 10 2010 032 057

(51) Int. Cl.

| | |
|---|---|
| ***F04C 2/00*** | (2006.01) |
| ***F01B 13/06*** | (2006.01) |
| ***F04B 1/04*** | (2006.01) |
| ***F04B 27/04*** | (2006.01) |

(52) U.S. Cl.

CPC ..... *F04C 2/00* (2013.01); *F01B 13/061* (2013.01); *F04B 1/0408* (2013.01); *F04B 1/0435* (2013.01); *F04B 1/0439* (2013.01); *F04B 27/0409* (2013.01); *F04B 27/0437* (2013.01); *F04B 27/0442* (2013.01)

(58) Field of Classification Search

CPC ..... F01B 13/061; F04B 1/0417; F04B 1/053; F04B 27/0418

USPC ..... 92/72, 129

See application file for complete search history.

(56) References Cited

U.S. PATENT DOCUMENTS

| | | | | |
|---|---|---|---|---|
| 3,223,046 A * | 12/1965 | Eickmann | F01B 1/0644 | 91/488 |
| 3,783,748 A * | 1/1974 | Cunningham | F01B 3/0085 | 91/488 |
| 3,874,275 A * | 4/1975 | Cunningham | F01B 1/0644 | 91/488 |
| 3,899,958 A * | 8/1975 | Spencer | F03C 1/0406 | 91/492 |

(Continued)

FOREIGN PATENT DOCUMENTS

| | | |
|---|---|---|
| DE | 24 60 512 A1 | 6/1976 |
| DE | 35 30 979 A1 | 3/1987 |

(Continued)

OTHER PUBLICATIONS

International Search Report corresponding to PCT Application No. PCT/EP2011/003083, mailed Mar. 2, 2012 (German and English language document) (7 pages).

*Primary Examiner* — John K Fristoe, Jr.
*Assistant Examiner* — Matthew Wiblin
(74) *Attorney, Agent, or Firm* — Maginot, Moore & Beck LLP

(57) ABSTRACT

A radial piston machine includes a piston having a base which is provided with a roller. The roller is held secure by a bearing shell that is inserted in the piston base.

14 Claims, 3 Drawing Sheets

(56) References Cited

U.S. PATENT DOCUMENTS

| | | | | | |
|---|---|---|---|---|---|
| 4,018,137 | A * | 4/1977 | Fricke | F01B 1/0644 | 91/488 |
| 5,848,565 | A * | 12/1998 | Thoma | F04B 1/1072 | 417/219 |
| 5,870,942 | A * | 2/1999 | Thoma | F04B 1/1071 | 92/12.1 |
| 2008/0106123 | A1* | 5/2008 | Lakic | B62D 25/04 | 296/205 |
| 2008/0205802 | A1* | 8/2008 | Dantlgraber | F04B 1/0408 | 384/100 |
| 2009/0110564 | A1* | 4/2009 | Simon | F04B 1/2007 | 417/53 |
| 2009/0183629 | A1 | 7/2009 | Lemaire et al. | | |

FOREIGN PATENT DOCUMENTS

| | | | |
|---|---|---|---|
| DE | 39 19 456 | A1 | 12/1990 |
| DE | 39 26 185 | A1 | 2/1991 |
| DE | 10 2007 004 069 | A1 | 7/2008 |

* cited by examiner

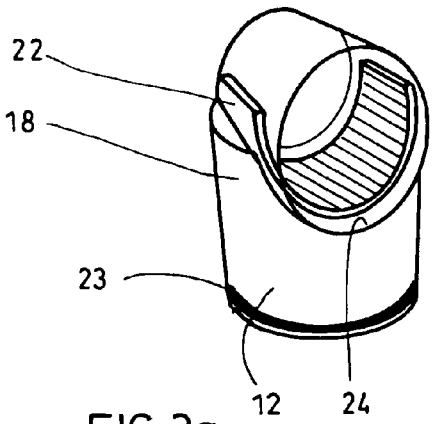
FIG.2a
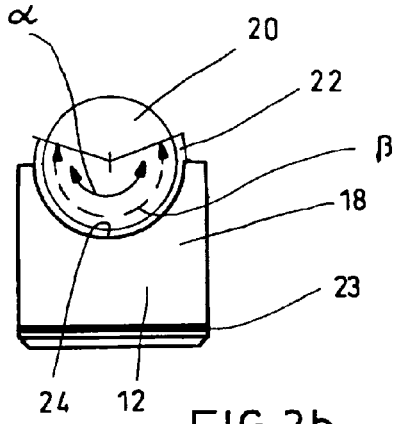
FIG.2b
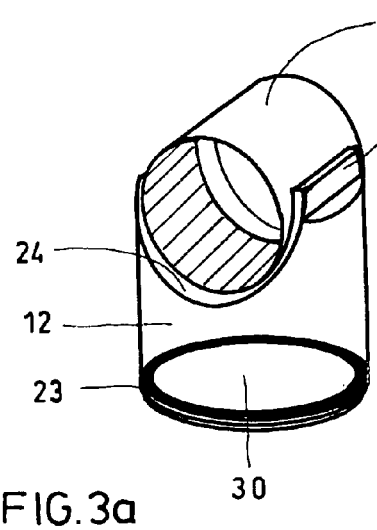
FIG.3a
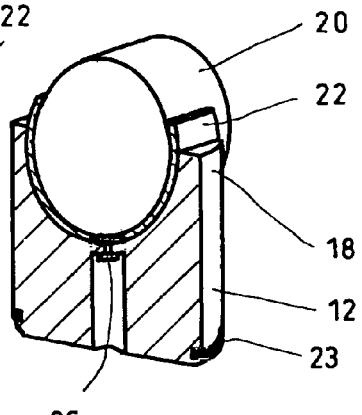
FIG.3b
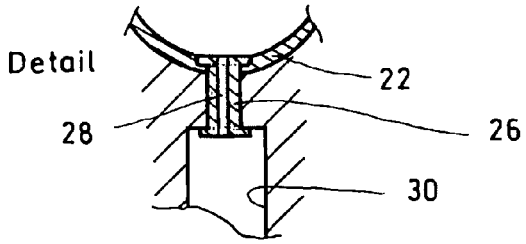

RADIAL PISTON MACHINE AND PISTON FOR A RADIAL PISTON MACHINE OF THIS TYPE

This application is a 35 U.S.C. §371 National Stage Application of PCT/EP2011/003083, filed on Jun. 22, 2011, which claims the benefit of priority to Serial No. DE 10 2010 032 057.9, filed on Jul. 23, 2010 in Germany, the disclosures of which are incorporated herein by reference in their entirety.

BACKGROUND

The disclosure relates to a radial piston machine as per the description below and to a piston suitable for a radial piston machine.

A radial piston machine of said type and a piston of said type are known for example from DE 39 19 456 C2. Said document discloses a radial piston machine having a stroke ring which is fixed with respect to a housing and which may for example be arranged with a cam path or eccentrically with respect to a rotatably mounted cylinder star. In the cylinder star, a multiplicity of pistons is guided so as to be displaceable in the radial direction, said pistons being supported on the stroke ring in each case by means of a roller. In the known solutions, said roller is rotatably mounted on the piston foot via a bearing shell, wherein captive retention of the piston is realized by virtue of the fact that the piston foot extends around the roller over more than 180°, such that the roller is secured in the radial direction. A problem of said solution is that considerable outlay is required for the machining of the piston foot, because the embracing configuration of the piston foot cannot be realized by means of simple grinding, but rather must be formed by means of transverse milling or stamping. Such production methods are relatively imprecise, such that a precise bearing shell fit in the piston foot cannot be ensured. In the worst case, bearing shell fracture may occur.

A similar embodiment of a piston foot is also disclosed in DE 39 26 185 C2. In said variant, too, the roller 1 is secured by an embracing form of the piston foot.

US 2009/0183629 A1 presents a piston in which the embracing form is realized not by means of a cutting-type machining process but rather by means of a crimping process. In one variant, in said known piston arrangement, the bearing shell also extends around the roller over more than 180°—all of said solutions however require that the piston foot be of crimpable configuration. As a result of the required crimping, the production outlay is likewise considerable, wherein a crimped securing arrangement necessitates the provision of a suitable piston material, such that there are certain restrictions with regard to material selection.

By contrast, it is the object of the disclosure to provide a radial piston machine and a piston which is suitable for such a radial piston machine, in which a roller is captively retained in a simple manner.

Said object is achieved, with regard to the radial piston machine, by means of the features described below, and with regard to the piston, by means of the features of the coordinate description below.

The description below relates to advantageous refinements of the disclosure.

SUMMARY

The radial piston machine according to the disclosure has a stroke ring which is fixed with respect to a housing and on the stroke path of which a multiplicity of pistons which are movable in a rotatably mounted cylinder star are supported via in each case one roller. Each roller is rotatably mounted on a piston foot via a bearing shell. According to the disclosure, the captive retention means is formed substantially by the bearing shell. That means that, according to the disclosure, the function of captive retention is reassigned from the piston, which is difficult to machine, to the bearing shell which, as a relatively areal component, is significantly easier to machine.

In one variant of the disclosure, the bearing shell extends around the roller over a circumferential angle of greater than 180°—in other words, the bearing shell embraces the roller such that the latter is secured in the radial direction.

In said variant, it is preferable for a receptacle in the piston foot for the bearing shell to extend around the roller over a maximum of 180°—that is to say the piston foot is not designed with an embracing form, such that the bearing shell receptacle can be produced in a very simple manner, for example by means of plunge-cut grinding. As a result of said simple machining, it is possible for the bearing shell receptacle to be produced very precisely, such that bearing shell fracture as a result of incorrect support is virtually ruled out.

In a preferred exemplary embodiment of the disclosure, the bearing shell is connected to the piston foot by adhesive bonding or by means of a rivet.

It has proven to be a particularly simple solution for the rivet to be formed as a blind rivet.

The fixing of the bearing shell in position in the piston foot is particularly reliable if said bearing shell is fastened to the piston foot by adhesive bonding and by riveting.

To minimize the friction and wear in the region of the roller bearing arrangement, the rivet may be formed with a duct for the supply of fluid to the bearing region.

Said supply of fluid may take place via a piston bore which has a pressure medium connection to the duct of the rivet.

To further minimize the friction, a hydrostatic field may be formed in the bearing shell, to which hydrostatic field pressure medium is supplied via the duct.

The piston according to the disclosure is accordingly formed with a bearing shell whose geometry is selected such that it also acts as a captive retention means for a roller.

It is preferable if the bearing shell embraces the roller, that is to say extends around at least one portion of the roller over more than 180°.

BRIEF DESCRIPTION OF THE DRAWINGS

Preferred exemplary embodiments of the disclosure will be explained in more detail below on the basis of schematic drawings, in which:

FIG. 2 shows views of a first exemplary embodiment of a piston for a radial piston machine of said type;

FIG. 3 shows views of a further exemplary embodiment of a radial piston machine.

DETAILED DESCRIPTION

Figure 1:
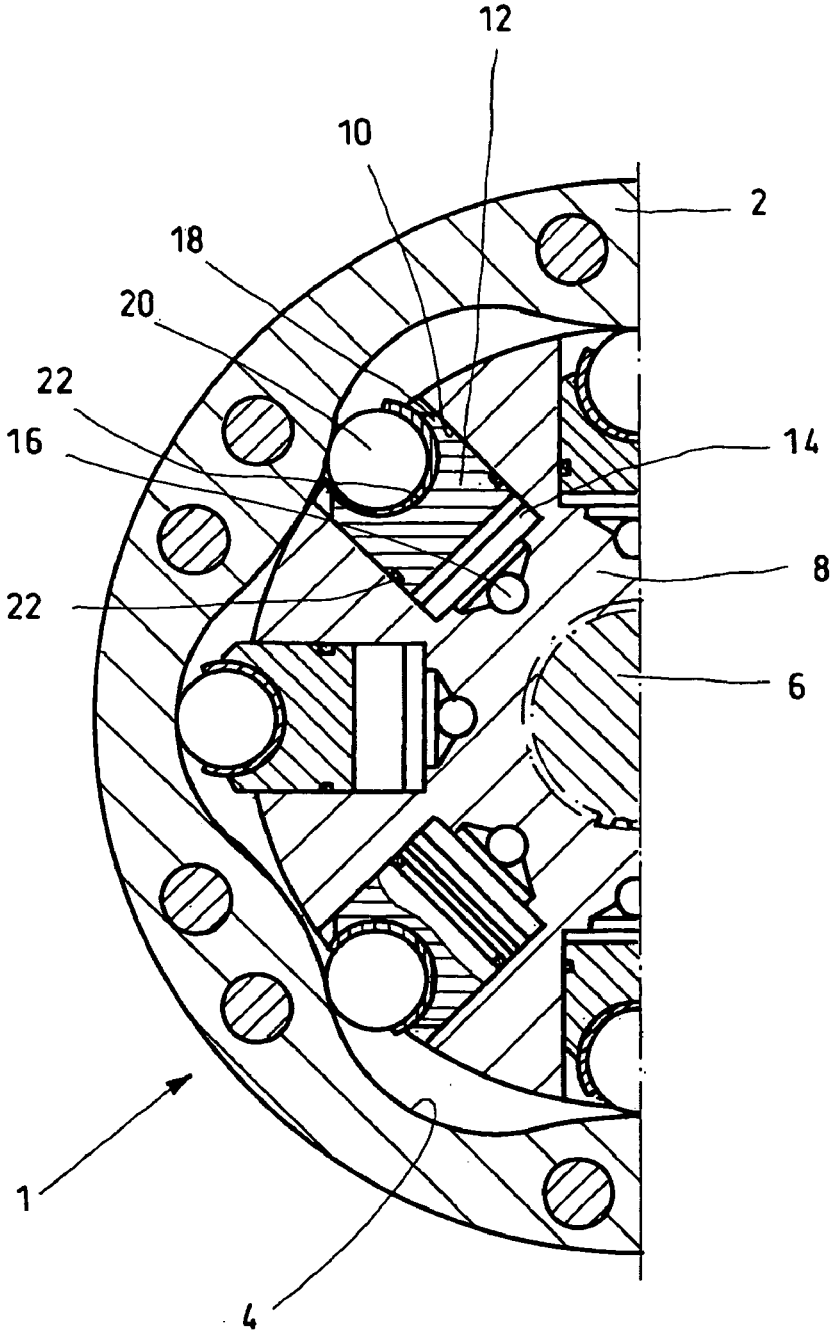
FIG. 1 shows a section through an axial piston machine.

FIG. 1 shows a diagonal section through a radial piston pump, wherein for simplicity, owing to the symmetrical construction, only one half of the section is illustrated. A radial piston pump of said type has a stroke ring 2 which is mounted in a housing—not shown—and whose inner circumferential surface is formed as a cam path 4. Within the stroke ring 2 there is mounted a cylinder star 8 which is connected rotationally conjointly to a pump shaft 6 and in which are formed a multiplicity of cylinder bores 10 extending in the radial direction. In each cylinder bore 10, a piston 12 is guided so as to be displaceable in the radial direction of the cylinder star 8. Said piston 12 delimits, together with the cylinder bore 10, a working chamber 14, the volume of which is defined by the piston stroke. Said working chamber 14 can be connected via a pressure medium duct 16 and via inlet and outlet valves (not illustrated) to a tank or to a pressure port, such that during an expansion stroke of the piston 12, pressure medium is delivered into the working chamber 14, and during a compression stroke, pressure medium is delivered out of the working chamber 14 to the pressure port.

Each piston has a piston foot 18 in which is rotatably mounted a cylindrical roller 20 which rolls along the cam path 4 as the cylinder star 8 rotates. In the illustrated exemplary embodiment, said cam path is of undulating design, such that each piston 12 performs multiple piston strokes during one revolution. It is self-evidently also possible for some other geometry to be used instead of such an undulating cam path 4. In principle, the concept according to the disclosure is also applicable to a radial piston pump with an eccentric drive, in which the pump shaft axis and the stroke ring axis are offset.

The roller 20 is received in the piston foot 18 via a bearing shell 22. By contrast to the prior art, the captive retention of the roller 20 is realized not by means of an embracing form of the piston foot 18 but rather by means of the bearing shell 22. This will be explained on the basis of the individual illustrations of a piston in FIGS. 2 and 3.

FIG. 2*a* shows a three-dimensional, highly schematic illustration of a single piston 12 of the radial piston machine 1 from FIG. 1. According to said figure, the piston 12 is of substantially cylindrical form and bears, at its working-chamber-side end portion, a sealing ring 23 which is inserted into an annular groove (see FIG. 1), by means of which sealing ring the working chamber 14 is sealed off radially to the outside. Into the piston foot 18, which is situated at the top in FIG. 2, there is formed a cylinder-segment-shaped indentation 24 which is particularly clearly visible in the illustration of FIG. 2*b*. The bearing shell 22 is inserted into said indentation 24.

As emerges particularly clearly from FIG. 2, the indentation 24 is formed such that the roller 20 which is inserted into the bearing shell 22 is extended around over a circumferential angle $\alpha$ of at most 180°. In the specific exemplary embodiment, the indentation 24 is, in the view of FIG. 2, formed as a semicircle—that is to say the circumferential angle is 180°.

In FIGS. 2*a* and 2*b*, the bearing shell 22 embraces the outer circumference of the roller 20, that is to say the circumferential angle $\beta$ (dashed line in FIG. 2*b*) over which the bearing shell 22 extends is greater than 180°. The roller 20 is thus received in the bearing shell 22 in a positively locking manner in the radial direction and is thus fixed in position. The fit is however formed such that the roller 20 can rotate with relatively low friction. With the solution according to the disclosure, therefore, the function of captive retention is reassigned to the bearing shell side, whereas the piston foot 18 is of relatively simple form and can thus be machined in a simple manner as described in the introduction. The piston can thus be formed in a very simple manner, for example by means of plunge-cut grinding or similar methods, or alternatively by sintering, such that a precise receptacle is created for the bearing shell 22.

In the exemplary embodiment illustrated, the bearing shell 22 is adhesively bonded into the indentation 24, wherein the areal fit, which is formed with high accuracy, permits a high-strength adhesive bond. The insertion of the roller 20 into the bearing shell 22 can take place in a simple manner in the axial direction.

FIG. 3 shows a refinement of the exemplary embodiment according to FIG. 2. The embodiment of the bearing shell 22, of the roller 20 and of the piston 12 corresponds substantially to the exemplary embodiment described above, such that explanations in this regard can, by reference to the embodiments above, be omitted. In addition to the adhesive bonding of the bearing shell 22 to the piston foot 18, the bearing shell 22 is fixed in position by means of a rivet 26. Said rivet may be formed for example as a blind rivet and has a passage bore 28 which opens out at one side in the chamber around which the bearing shell 22 extends and at the outer side in an axial bore 30 of the piston 12. Said axial bore 30 has a pressure medium connection to the pressure side of the radial piston pump, such that pressure medium is supplied to the bearing receptacle via the axial bore 30 and the passage bore 28 and the friction is thus reduced. Accordingly, said rivet 26 performs a dual function—it serves firstly for fastening the bearing shell 22 in the piston foot 18, and it secondly forms a part of a lubricating oil flow path for minimizing the friction of the roller 20.

As already indicated above, it is preferable for the bearing shell 22 to be connected to the piston foot 18 by adhesive bonding and by riveting. It is self-evidently alternatively also possible for one of said variants or for some other fastening solution to be selected. As can be seen in the detail illustration, the rivet head is formed flush with the inner circumferential wall of the bearing shell 22 or is recessed, such that an optimum sliding surface for the roller 20 is provided.

Figure 4:
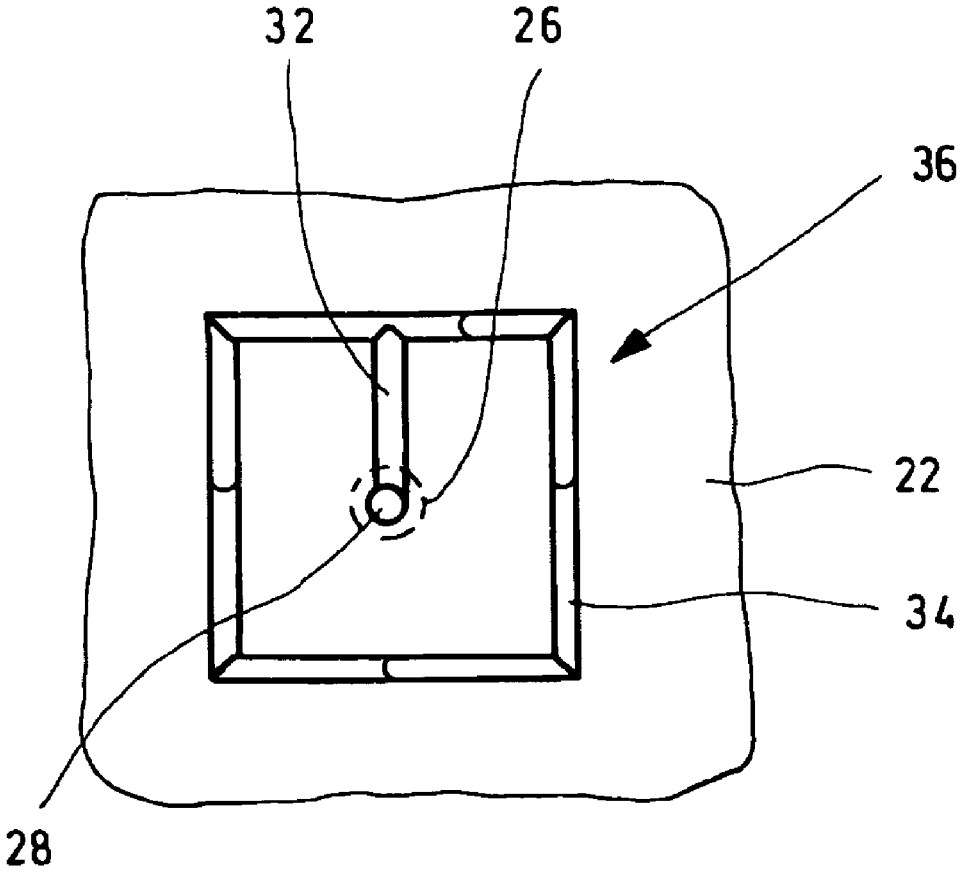
FIG. 4 shows a hydrostatic field for minimizing friction for the pistons as per FIGS. 2 and 3.

To improve the bearing arrangement, a hydrostatic field may be formed in the bearing shell 22. FIG. 4 shows such a variant, wherein the view according to FIG. 4 is a view into the bearing shell 22 in the axial direction of the piston 12. It is possible to see the mouth region of the passage bore 28. In the exemplary embodiment according to FIG. 3, said passage bore 28 is formed in the rivet 26 (dashed line in FIG. 4); said passage bore 28 may self-evidently also be formed directly in the bearing shell 22. The mouth region of the passage bore 28 is connected via a radial groove 32 to an encircling, frame-shaped channel 34 which is formed for example by milling or the like. Instead of the rectangular geometry of the encircling channel 34, it is self-evidently also possible to select some other geometry suitable for a hydrostatic bearing arrangement. The production of said hydrostatic field 36 is particularly simple if it is formed before the bending of the bearing shell 22. After production of the hydrostatic field 36 by milling or some other process, the planar bearing shell blank 22 is then bent into the desired cylindrical shell shape. It is self-evidently also possible for the bearing shell 22 to be produced by sintering or the like and, in this case, for the hydrostatic field 36 to be formed in one working step.

If the rivet 26 is to be used, the passage bore 28 indicated in FIG. 4 may also be formed initially as a bore in the bearing shell 22, into which bore the rivet 26 is then inserted. With regard to function, there is then correspondence with the exemplary embodiment described above.

Disclosed is a radial piston machine having a piston which bears, on its piston foot, a roller. The captive retention means for said roller is formed by a bearing shell which is inserted into the piston foot.

The invention claimed is:

1. A radial piston machine comprising:

a housing;

a rotatably mounted cylinder star;

a stroke ring which is fixed with respect to the housing; and a multiplicity of pistons supported on the stroke ring and guided in the rotatably mounted cylinder star, wherein each piston of the multiplicity of pistons has a roller which is rotatably mounted on a piston foot via a bearing shell, wherein a captive retention mechanism for the roller is formed by the bearing shell, wherein a receptacle on the piston foot extends around the bearing shell over no more than 180°, and wherein the bearing shell extends around the roller over a circumferential angle of greater than 180°, such that a portion of the bearing shell is unsupported by the piston foot.

2. The radial piston machine as claimed in claim 1, wherein the bearing shell is fastened to the piston foot by a rivet.

3. The radial piston machine as claimed in claim 2, wherein the rivet is a blind rivet.

4. The radial piston machine as claimed in claim 2, wherein the rivet has a passage duct configured to supply fluid to a bearing region.

5. The radial piston machine as claimed in patent claim 4, wherein:

for each piston of the multiplicity of pistons the passage duct opens to a bore of each corresponding piston of the multiplicity of pistons, and the bore has a pressure medium connection to high pressure.

6. The radial piston machine as claimed in claim 4, wherein a hydrostatic field is formed in the bearing shell in a region of the passage duct.

7. A radial piston machine, comprising:

a housing;

a rotatably mounted cylinder star;

a stroke ring which is fixed with respect to the housing; and a multiplicity of pistons supported on the stroke ring and guided in the rotatably mounted cylinder star, wherein:

each piston of the multiplicity of pistons has a roller which is rotatably mounted on a piston foot via a bearing shell;

a captive retention mechanism for the roller is formed substantially by the bearing shell; wherein the bearing shell is connected to the piston foot by adhesive bonding and riveting; wherein the bearing shell extends around the roller over a circumferential angle of greater than 180, such that a portion of the bearing shell is unsupported by the piston foot.

8. A piston for a radial piston machine, comprising:

a piston foot defining a receptacle;

a bearing shell partially received by the receptacle;

a roller mounted on the bearing shell; and a captive retention mechanism for the roller formed by the bearing shell, wherein the receptacle extends around the bearing shell over no more than 180°, and wherein the bearing shell extends around the roller over a circumferential angle of greater than 180°, such that a portion of the bearing shell is unsupported by the piston foot.

9. The piston as claimed in claim 8, wherein the bearing shell is fastened to the piston foot by a rivet.

10. The piston as claimed in claim 9, wherein the rivet is a blind rivet.

11. The piston as claimed in claim 9, wherein the bearing shell is fastened to the piston foot by adhesive bonding and a rivet.

12. The piston as claimed in claim 9, wherein the rivet has a passage duct configured to supply fluid to a bearing region of the bearing shell.

13. The piston as claimed in claim 12, wherein:

the passage duct opens to a bore of the piston, and the bore has a pressure medium connection to high pressure.

14. The piston machine as claimed in claim 12, wherein a hydrostatic field is formed in the bearing shell in a region of the passage duct.

* * * * *